US005116012A

United States Patent [19]

Offenhauer et al.

[11] Patent Number: 5,116,012

[45] Date of Patent: May 26, 1992

[54] CLIP BOARD

[75] Inventors: Keith L. Offenhauer, Bradenton, Fla.; Harold M. Zimmermann, Jr., Philadelphia, Pa.

[73] Assignee: Laser Works, Inc., Sarasota, Fla.

[21] Appl. No.: 647,428

[22] Filed: Jan. 28, 1991

[51] Int. Cl.[5] ..... A47B 97/00

[52] U.S. Cl. ..... 248/452; 24/67.11; 211/45; 211/50; 281/45

[58] Field of Search ..... 248/452, 451, 450, 441.1; 211/45, 50; 281/45; 24/67.7, 67.11

[56] References Cited

U.S. PATENT DOCUMENTS

| | | | |
|---|---|---|---|
| 2,693,370 | 11/1954 | Wheatley | 248/451 |
| 4,375,296 | 3/1983 | Chang | 211/45 |
| 4,531,642 | 7/1985 | Racich | 248/451 |
| 4,628,572 | 12/1986 | Chang | 281/45 |
| 4,645,163 | 2/1987 | Zovar | 281/45 |
| 4,948,172 | 8/1990 | Chang | 281/45 |

*Primary Examiner*—David L. Talbott
*Attorney, Agent, or Firm*—Charles J. Prescott

[57] ABSTRACT

A clip board including a generally rectangular flat board for supportively receiving writing paper or the like thereatop and a pivotally movable paper clamp connected adjacent one end of the board and spaced above the board's writing surface. The paper clamp is pivotally interconnected to the board about a transverse axis parallel to the one end of the board by at least one downwardly extending retaining bracket which is inserted into a mating longitudinal slot in the board and pivotally held thusly by a transverse retainer pin. The retainer pin engages transversely through the lower end of the retaining bracket and extends in either direction beyond the width of the slot to engage against the bottom surface of the board adjacent the slot. A simple generally V-shaped spring acting in compression is positioned between the paper clamp and the board so as to pivotally bias the paper clamp against the board along the paper clamp's paper engaging edge which faces toward the central portion of the board. The paper clamp, in a broad sense, may also include a housing for containing a stack of alternately adhered memo sheets. This invention thus facilitates quick assembly and reduces or eliminates transverse bending or warping of the board during use.

6 Claims, 3 Drawing Sheets

CLIP BOARD

BACKGROUND OF THE INVENTION

This invention relates generally to clip boards and more particularly to a clip board which facilitates quick assembly and reduces warpage or bending of the board itself during use.

Conventional clip boards are well known. They are also well known to undergo transverse bending or warpage of the board as a result of uneven clamping forces between the paper clamp and the board. Further, the paper clamp is typically used for nothing more than releasing and engaging clamping pressure against paper stock or the like and hanging the clip board on a nail or pin in a wall or vertical surface.

The present invention provides for an easily assemblable clip board which utilizes simple V-shaped spring members to appropriately bias the paper clamp and also reduce or eliminate uneven clamping pressure against the paper stock by controlling or eliminating transverse bending or warping of the board. This invention also may include a housing atop the paper clamp for retaining a stack of alternately adhered memo sheets therewithin which are conveniently positioned for accessibility.

BRIEF SUMMARY OF THE INVENTION

This invention is directed to a clip board including a generally rectangular flat board for supportively receiving writing paper or the like thereatop and a pivotally movable paper clamp connected adjacent one end of the board and spaced above the board's writing surface. The paper clamp is pivotally interconnected to the board about a transverse axis parallel to the one end of the board by at least one downwardly extending retaining bracket which is inserted into a mating longitudinal slot in the board and pivotally held thusly by a transverse retainer pin. The retainer pin pivotally engages through the lower end of the retaining bracket and extends in either direction beyond the width of the slot to engage against the bottom surface of the board adjacent the slot. A simple generally V-shaped spring acting in compression is positioned between the paper clamp and the board so as to pivotally bias the paper clamp against the board along the paper clamp's paper engaging edge which faces toward the central portion of the board and to maintain assembly arrangement without need of fasteners. In the broadest form, the paper clamp may also include a housing for containing a stack of alternately adhered memo sheets. This invention thus facilitates quick assembly and reduces or eliminates transverse bending or warping of the board during use.

It is therefore an object of this invention to provide a clip board which is extremely economical to both manufacture and assemble.

It is another object of this invention to eliminate the need for other fastening means such as rivets or welding in holding the assembly together during use.

It is yet another object of this invention to provide a clip board which virtually eliminates transverse bending of the board so as to maintain the flatness integrity of the working surface of the board during use.

It is yet another object of this invention to provide a clip board which includes convenient means for dispensing a memo sheet from a stack of alternately adhered memo sheets.

In accordance with these and other objects which will become apparent hereinafter, the instant invention will now be described with reference to the accompanying drawings.

DETAILED DESCRIPTION OF THE INVENTION

Figure 1:
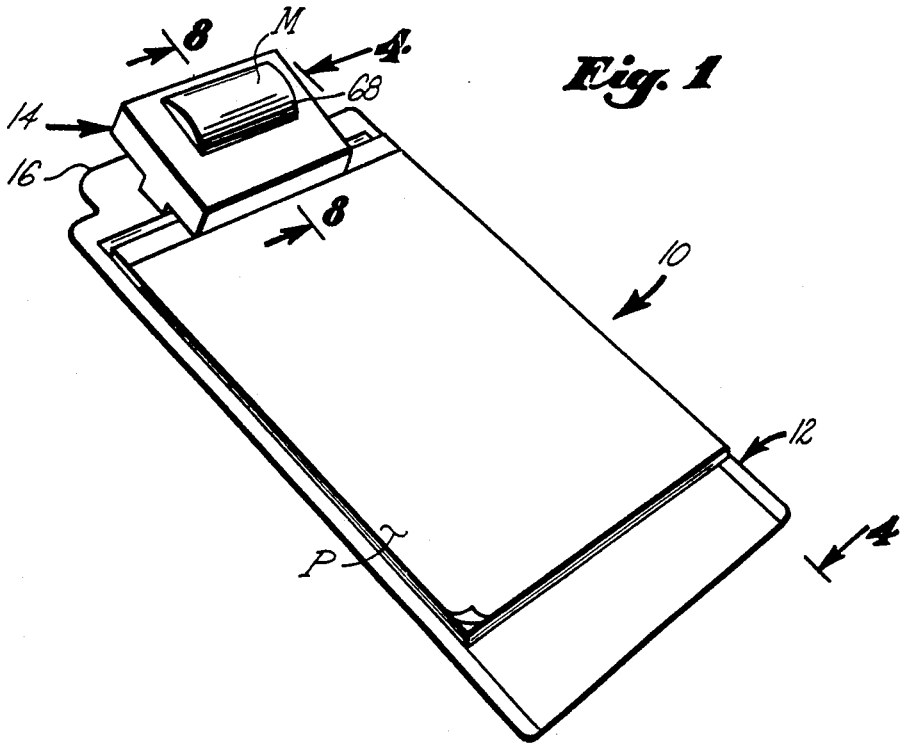
FIG. 1 is a perspective view of the invention.
Figure 2:
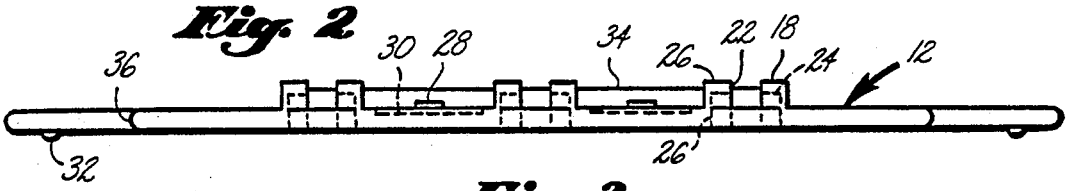
FIG. 2 is an end elevation view of the board in the direction of arrows 2—2 in FIG. 3.

Referring now to the drawings and firstly to FIG. 1, the invention is shown generally at numeral 10. This clip board 10 includes a flat, thin rectangular base 12 and a paper clamp 14 which is pivotally connected adjacent one end of the base 12. The upper working surface of base 12 is sized to receive writing material or the like thereatop, shown typically at P, to be clamped in place thusly by paper clamp 14 as will be described herebelow. Both base 12 and paper clamp 14 are preferably fabricated of molded plastic material.

Referring additionally to FIGS. 2 to 9, the paper clamp 14 includes a molded base 40 having a generally rectangular bottom 58 from which downwardly extending pivot brackets 42 are formed. These pivot brackets are V-shaped having a radiused apex 66. These retaining brackets 42 are arranged transversely in a line and are sized to insertably fit within mating longitudinal slots 22 formed into board 12 adjacent and in line parallel to margin 16.

These retaining brackets 42 are of sufficient length so as to extend beyond slots 22 downwardly a distance sufficient so that cylindrical pins 44 may be inserted transversely into apex 66. These pins 24 are of sufficient length longer than the width of slots 22 so as to mate within cavities 24 and 26 molded into upward projections 18 and 20, respectively on either side of each slot 22.

Figure 4:
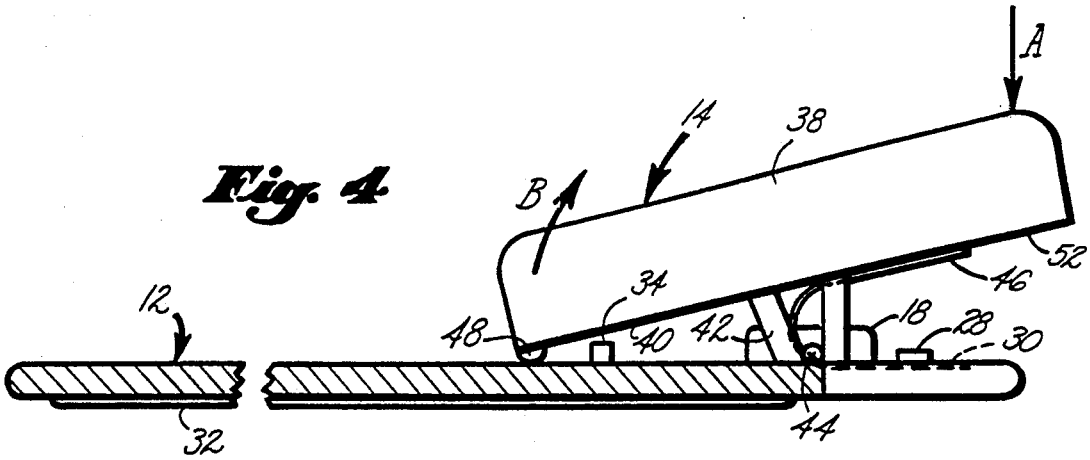
FIG. 4 is a section view in the direction of arrows 4—4 in FIG. 1.
Figure 5:
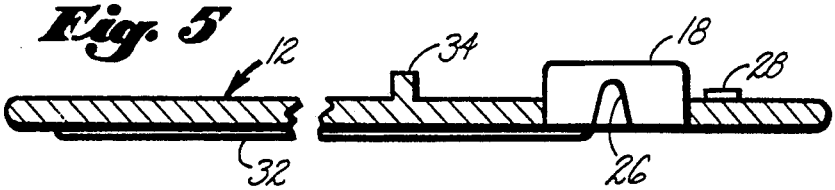
FIG. 5 is a section view in the direction of arrows 5—5 in FIG. 3.

With pins 44 in place thusly in alignment with transverse axis C and acting against apex 66, cavities 24 and 26, the paper clamp 14, as best seen in FIG. 4, is pivotable in the direction of arrow B about pins 44 and axis C.

Figure 12:
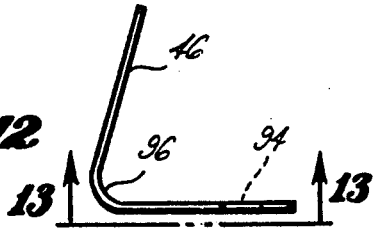
FIG. 12 is a side elevation view of the V-shaped paper clamp biasing spring in its free orientation.
Figure 13:
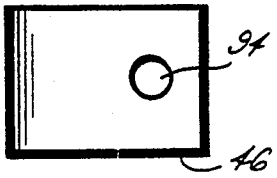
FIG. 13 is a view in the direction of arrows 13—13 in FIG. 12.

Because pins 44 are loosely positioned as described above, assembly of this clip board 10 is made extremely simple and quick. To retain this arrangement and to provide the necessary torsional or pivotal biasing necessary to activate the paper clamp 14, a simple spring arrangement as best seen in FIGS. 4, 12 and 13, is provided. A spring 46 is formed of a rectangular length of thin, flat spring stock and formed into a V-shape generally and having a free configuration shown in FIG. 12. In its compressively biased position shown in FIG. 4, spring 46, having its arms rearwardly extending as shown about pins 44, acts to bias the paper clamp counterclockwise into the position shown wherein a paper engaging edge or bead 48 presses against the upper surface of board 12. However, each sprin 46 also upwardly acts against bottom 52 to hold pins 44 within cavities 24 and 26.

Springs 46 are also provided with an aperture 94 in one leg thereof which engages over posts 28 molded and upwardly extending from pockets 30 formed into the upper surface of board 12. Thus, when springs 46 are assembled, the aperture 94 snaps over post 28 as one let of spring 46 fits into pocket 30 to securely engage the spring 46 it in that position.

Thus, by this spring arrangement, pins 44 are lockably retained within cavities 24 and 26 forming a pivotal axis D so that, by downward manual pressure in the direction of arrow A in FIG. 4, the paper clamp 14 will rotate in the direction of arrow B so as to release paper held between the upper surface of board 12 and margin 48.

Figure 3:
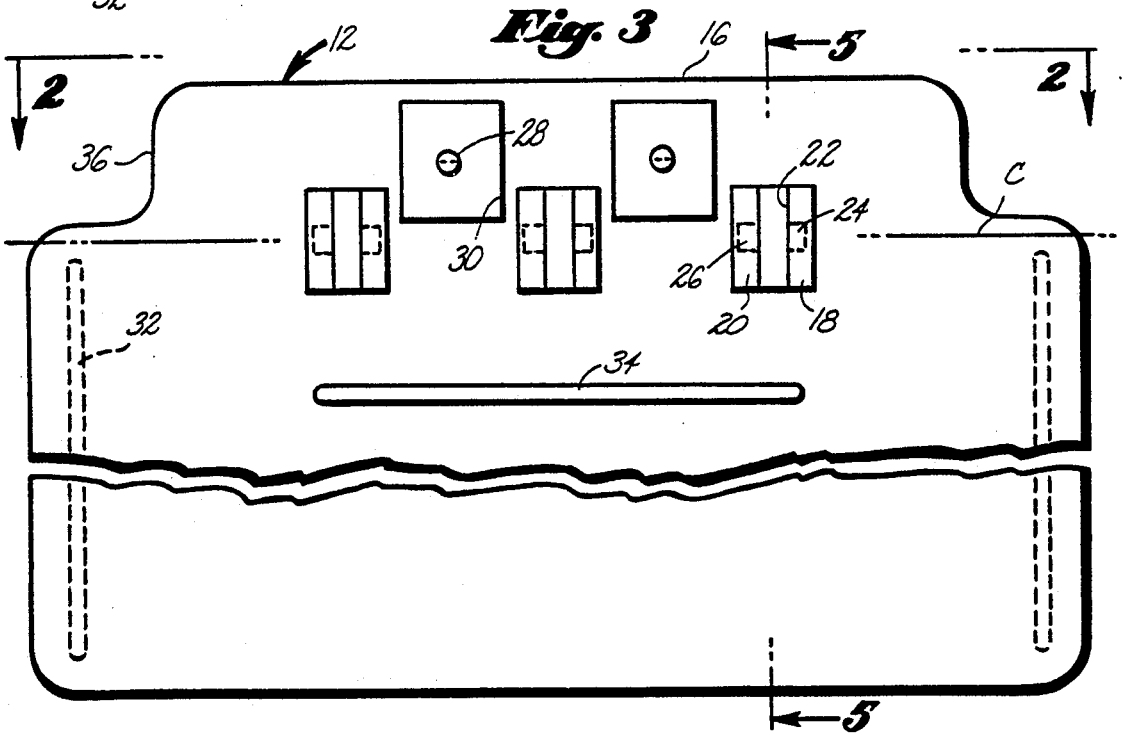
FIG. 3 is a top plan elevation view of the board of the invention.

One functional problem typical of all clip boards is the tendency of transverse warpage or bending of the board itself due to uneven clamping forces produced between paper clamp and board. The present invention 10, preferably utilizing at least two springs 46, evenly spaced as best seen in FIG. 3 about the longitudinal center line of board 12 and three pins 24 connected about axis C as previously described, virtually eliminates any such problem.

Board 12 also includes molded transverse stop 34 in its upper surface against which the writing material may be aligned. Longitudinal beads 32 molded into the lower surface provide a finger gap to facilitate grasping the clip board 10 when it is laid atop a flat surface.

Figure 8:
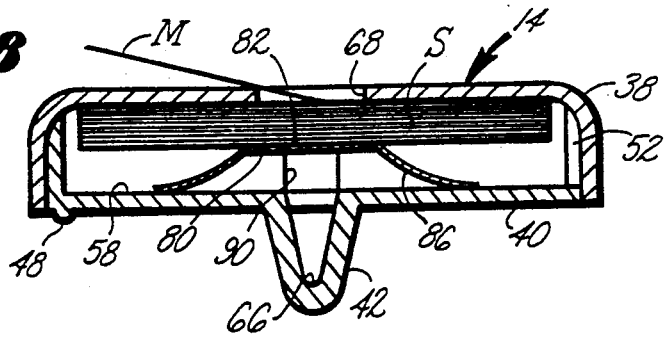
FIG. 8 is a section view of the paper clamp in the direction of arrows 8—8 in FIG. 1.

Referring to FIGS. 1 and 6 to 11, the paper clamp 14 includes an upper molded housing or cover 38 having a transverse aperture 68 formed through the top surface thereof. This housing 38 snapably engages over base 40 so as to form an interior cavity with bottom 58, and partitions or walls 50, 52, 54, and 56. This interior cavity is sized to receive a stack of alternately adhered or "fan folded" memo sheets S such as are manufactured and distributed by the 3M company under their trade designation POST-IT. A formed lifting spring 80 is positioned below the memo stack S and atop surface 58 as best seen in FIG. 8 so as to biasingly lift the memo stack S upwardly against cover 38. By this arrangement, one memo sheet M at a time extending through opening 68 may be dispensed.

Figure 10:
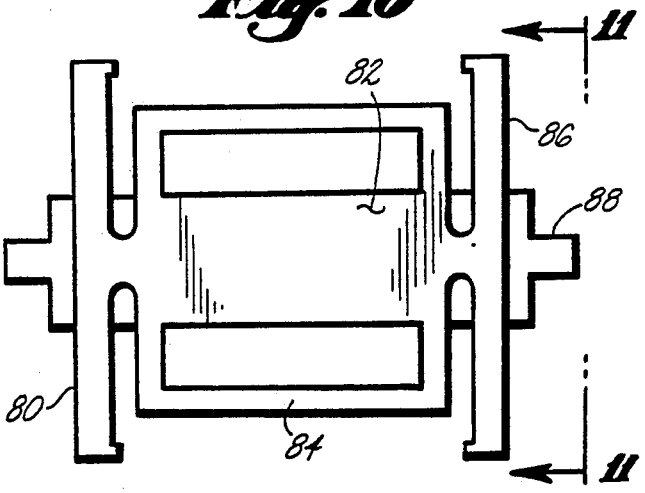
FIG. 10 is a top plan view of the flat spring contained within the housing for upwardly urging a stack of memo sheets contained therein.
Figure 11:
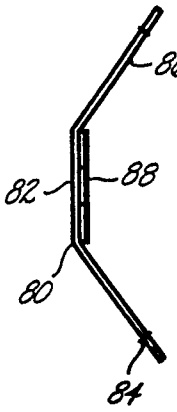
FIG. 11 is a view in the direction of arrows 11—11 in FIG. 10.

The lifting spring 80, as shown in FIGS. 8, 10 and 11, includes a central transverse main portion 82 which contacts against the bottom surface of the memo stack S. Two levels of biasing force are provided, the first by long flexible arms 86 which are always in contact with surface 58. The second level of force is activated when the memo stack S is thicker and heavier so as to more fully compress lifting spring 80. Then, shorter biasing arms 84 come in contact with surface 58. To maintain alignment of lifting spring 80, tabs 88 ride up and down within slots 90 and 92 formed into partitions 50 and 54 of base 40.

Figure 6:
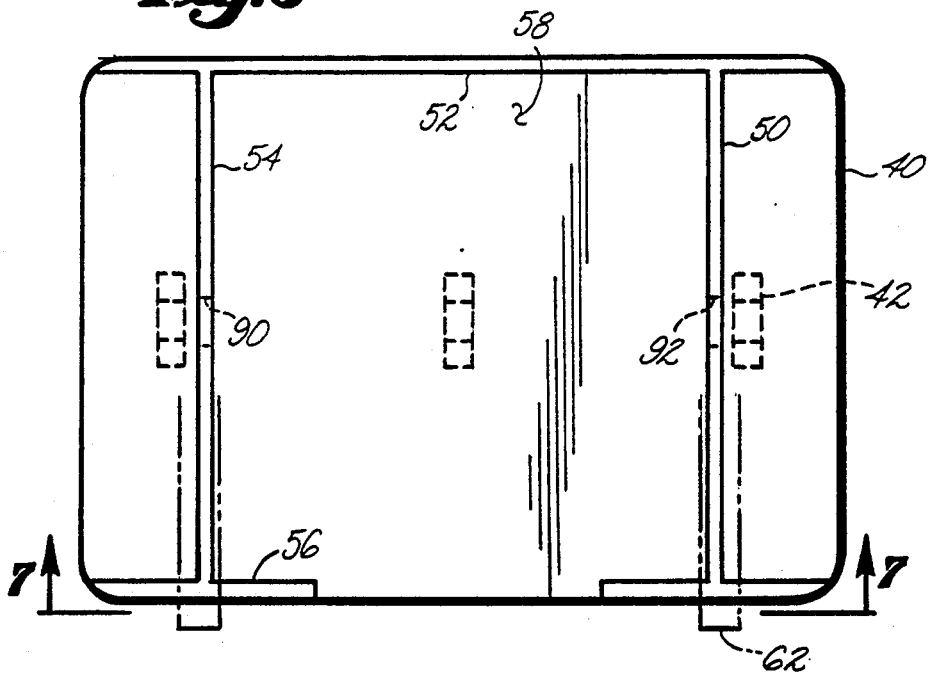
FIG. 6 is a top plan view of the base of the paper clamp of the invention.
Figure 7:
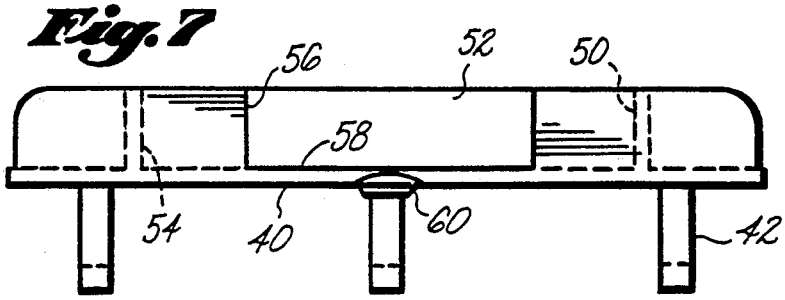
FIG. 7 is a view in the direction of arrows 7—7 in FIG. 6.
Figure 9:
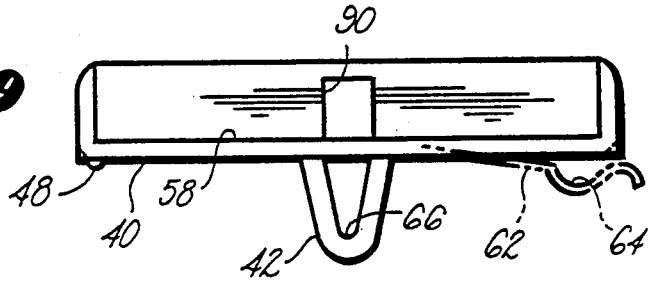
FIG. 9 is a side elevation view of the base of the paper clamp.

An optional feature of the present invention is shown in phantom in FIGS. 6 and 9 in the form of a pair of writing instrument retainer brackets 62. These brackets 62 are integrally molded and downwardly extend from base 40 and are contoured having radius 64 in sufficiently close proximity to base 40 so that brackets 62 must be resiliently deflected downwardly to fit a writing instrument between radius 64 and base 40. The cantilevered biasing force thus generated will retain a writing instrument transversely in that position until required for use.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A clip board comprising:

a generally flat, relatively thin, generally rectangular board having an upper surface sized to supportively receive writing paper there atop;

a movable paper clamp pivotably connected and spaced above and near one end of said board about a pivotal axis positioned generally parallel to and adjacent said one base end;

said paper clamp having at least one downwardly extending centrally positioned retaining bracket on said paper clamp, said retaining bracket structured at its lower end for insertion into a longitudinal slot formed into said board and for pivotal retention within said slot by insertion of a removable pin transversely through said lower end, said pin sized in length to straddle and extend in either direction beyond said slot;

said paper clamp also having a paper engaging edge which contacts against said board upper surface when said paper clamp is pivoted about said pivotal axis into a first position;

a generally V-shaped spring positioned and compressively acting between a lower surface of said paper clamp and said board upper surface to pivotally urge said paper clamp into said first position;

said paper clamp pivotably movable about said pivotal axis from said first position by manually pressing an area of said paper clamp on the opposite side of said pivotal axis from said paper engaging edge;

a housing engagable over said paper clamp forming an interior sized to receive a stack of alternately adhered paper memo sheets;

said housing having an opening in its upper surface for dispensing one of the memo sheets at a time.

2. A clip board as set forth in claim 1, wherein:

said spring is formed of a rectangular length of very thin flat resilient material;

one end of said spring including an aperture adjacent thereto for engagement over a mating post upwardly extending from said board upper surface;

said aperture and said post cooperatively positioned to maintain said spring in a working position wherein said paper engaging edge is biased against said board upper surface.

3. A clip board as set forth in claim 2, further comprising:

a pencil bracket connected to a lower surface of said paper clamp structured in cooperation with said paper clamp lower surface, to releasably retain a writing instrument and positioned transversely to, and spaced from, said board.

4. A clip board as set forth in claim 2, further comprising:

a pencil bracket connected to a lower surface of said paper clamp structured, in cooperation with said paper clamp lower surface, to releasably retain a writing instrument positioned transversely to, and space from, said board.

5. A clip board comprising:

a generally flat, relatively thin, generally rectangular board having an upper surface sized to supportively receive writing paper there atop;

a movable paper clamp having a cover removably engagable over a rectangular base, said paper clamp pivotably connected and spaced above and near one end of said board about a pivotal axis oriented transversely and parallel to said board;

said paper clamp having a plurality of downwardly extending retaining brackets positioned in a line transversely across said base, the distal lower ends of each of said plurality of retaining brackets inserted within a different longitudinal slot formed into said board and retained for pivotal movement only about said pivotal axis by a pin positioned transversely through each said lower end, each said pin sized in length to straddle and extend in either direction beyond said corresponding slot;

said paper clamp also having a paper engaging edge which contacts against said board upper surface when said paper clamp is pivoted about said pivotal axis into a first position;

a pair of generally V-shaped springs positioned and compressively acting between said base and said board upper surface to pivotally urge said paper clamp into said first position;

said paper clamp pivotably movable about said pivotal axis form said first position by manually pressing an area of said paper clamp on the opposite side of said pivotal axis from said paper engaging edge;

said cover and said base forming an interior sized to receive a stack of alternately adhered paper memo sheets;

said cover having an opening in its upper surface for dispensing one of the memo sheets at a time;

each spring of said pair of springs formed of a rectangular length of very thin flat resilient material;

one end of each said spring including an aperture adjacent thereto for engagement over a mating post upwardly extending from said board upper surface;

each said aperture and each said post cooperatively positioned to maintain each said spring in a working position wherein said paper engaging edge is biased against said board upper surface.

6. A clip board comprising:

a generally flat, relatively thin, generally rectangular board having an upper surface sized to supportively receive writing paper there atop;

a movable paper clamp pivotably connected and spaced above and near one end of said board about a pivotal axis positioned generally parallel to and adjacent said one base end;

said paper clamp also having a paper engaging edge which contacts against said board upper surface when said paper clamp is pivoted about said pivotal axis into a first position;

said paper clamp pivotably movable about said pivotal axis from said first position by manually pressing an area of said paper clamp on the opposite side of said pivotal axis from said paper engaging edge;

a housing engagable over said paper clamp forming an interior sized to receive a stack of alternately adhered paper memo sheets;

said housing having an opening in its upper surface for dispensing one of the memo sheets at a time.

* * * * *